US006415720B2

(12) United States Patent
Theurer et al.

(10) Patent No.: US 6,415,720 B2
(45) Date of Patent: Jul. 9, 2002

(54) MACHINE FOR RENEWING A RAILROAD TRACK

(75) Inventors: Josef Theurer, Vienna; Manfred Brunninger, Altenberg, both of (AT)

(73) Assignee: Franz Plasser Bahnbaumaschinen Industrigesellschaft m.b.H., Vienna (AT)

( * ) Notice: Subject to any disclaimer, the term of this patent is extended or adjusted under 35 U.S.C. 154(b) by 0 days.

(21) Appl. No.: 09/873,678

(22) Filed: Jun. 4, 2001

(30) Foreign Application Priority Data

Jun. 9, 2000 (AT) ..... 433/00 U

(51) Int. Cl.[7] ..... E01B 27/00
(52) U.S. Cl. ..... 104/7.3; 104/2; 37/104
(58) Field of Search ..... 104/2, 7.1, 7.3, 104/10, 12; 37/104, 105, 106, 107

(56) References Cited

U.S. PATENT DOCUMENTS 3,807,310 A * 4/1974 Erna et al. ..... 104/2
4,094,249 A * 6/1978 Theurer et al. ..... 104/2
5,357,867 A 10/1994 Theurer et al.

* cited by examiner

*Primary Examiner*—Mark T. Le
(74) *Attorney, Agent, or Firm*—Collard & Roe, P.C.

(57) ABSTRACT

A machine for renewing a railroad track on a ballast bed comprises a machine frame extending in a longitudinal direction, undercarriages for supporting the machine frame on the railroad track, a first tie transport device for receiving old ties and a second tie transport device for laying new ties, old tie transport devices being mounted on the machine frame and being spaced from each other in the longitudinal direction, and a crawler vehicle and ballast bed planing apparatus being arranged on the machine frame between the tie transport devices, the ballast bed planing apparatus being rotatable by 180° about a vertical axis.

4 Claims, 3 Drawing Sheets

MACHINE FOR RENEWING A RAILROAD TRACK

BACKGROUND OF THE INVENTION

1. Field of the Invention

The present invention relates to a machine for renewing a railroad track on a ballast bed, which comprises a machine frame extending in a longitudinal direction, undercarriages for supporting the machine frame on the railroad track, a first tie transport device for receiving old ties and a second tie transport device for laying new ties, the tie transport devices being mounted on the machine frame and being spaced from each other in the longitudinal direction, and a crawler vehicle and ballast bed planing apparatus arranged on the machine frame between the tie transport devices.

2. Description of the Prior Art

Such a machine, which may be operated in opposite driving directions, is disclosed in U.S. Pat. No. 5,357,867. In one driving direction, an old railroad track is renewed while a new railroad track is laid on a prepared planed surface in the opposite driving direction. During a track renewal operation, the machine is driven while supported by a crawler vehicle on a planed renewal track section from which the old track ties and rails have been removed, a ballast planing apparatus preceding the crawler vehicle in the driving direction for planing the ballast. The new track is laid on the planed ballast bed behind the crawler vehicle. For this purpose, the machine is driven in the opposite direction and must be retrofitted by mounting the crawler vehicle on the machine frame in front of the device for laying the new ties, in respect of the opposite driving direction. In addition, the tie elevator for laying the new ties is turned around while the tie transport device for receiving the old ties and the ballast planing apparatus are raised into an inoperative position.

SUMMARY OF THE INVENTION

It is the primary object of this invention to provide a railroad track renewal machine of the above-described type, which requires minimal retrofitting when driven in opposite directions.

The above and other objects are accomplished according to the invention with such a machine wherein the ballast bed planing apparatus is rotatable by 180° about a vertical axis.

Such a machine may be operated in opposite driving directions during a track renewal operation without any substantial retrofitting. This may be of considerable advantage, for example, when a double track is to be renewed. In this case, the machine may work back in the opposite direction on the other rail after one rail has been renewed, without having to engage in complicated and time-consuming retrofitting needed to turn the entire machine around. It is also advantageous to be able to drive from either side towards the renewal site to start the track renewal operation, depending on the prevailing conditions and without having to take into consideration the orientation of the machine. The ballast bed planing apparatus may always be rapidly and readily turned in the driving direction to be in the proper operating position for planing the ballast.

BRIEF DESCRIPTION OF THE DRAWING

The above and other objects, advantages and features of the present invention will become more apparent from the following detailed description of a now preferred embodiment thereof, taken in conjunction with the accompanying drawing wherein.

DETAILED DESCRIPTION OF PREFERRED EMBODIMENT

Figure 1:
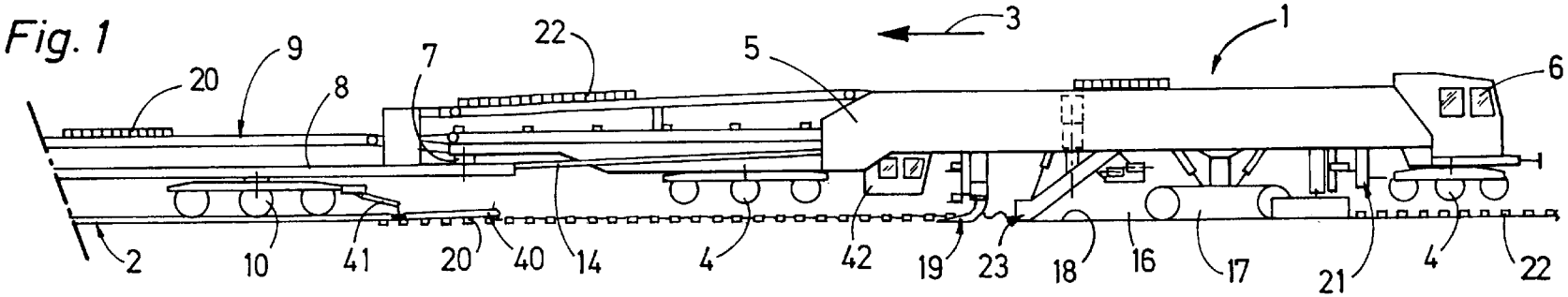
FIGS. 1 and 2 are schematic side elevational views of a railroad track renewal machine operable in opposite driving directions for a track renewal operation.

Referring first to FIG. 1, there is shown machine 1 for renewing railroad track 2 on a ballast bed. In FIG. 1, the machine is operated in a driving direction indicated by arrow 3. The machine comprises machine frame 5, extending in a longitudinal direction, and undercarriages 4, 4 for supporting the machine frame on the railroad track. A first tie transport device 19 is provided for receiving old ties 20 and a second tie transport device 21 for laying new ties 22. The tie transport devices are mounted on machine frame 5 and are spaced from each other in the longitudinal direction. A crawler vehicle 17 and ballast bed planing apparatus 23 are arranged on the machine frame between tie transport devices 19, 21. According to the invention and as will be explained more fully hereinbelow in connection with the description of FIGS. 4 and 5, the ballast bed planing apparatus is rotatable by 180° about a vertical axis.

Figure 3:
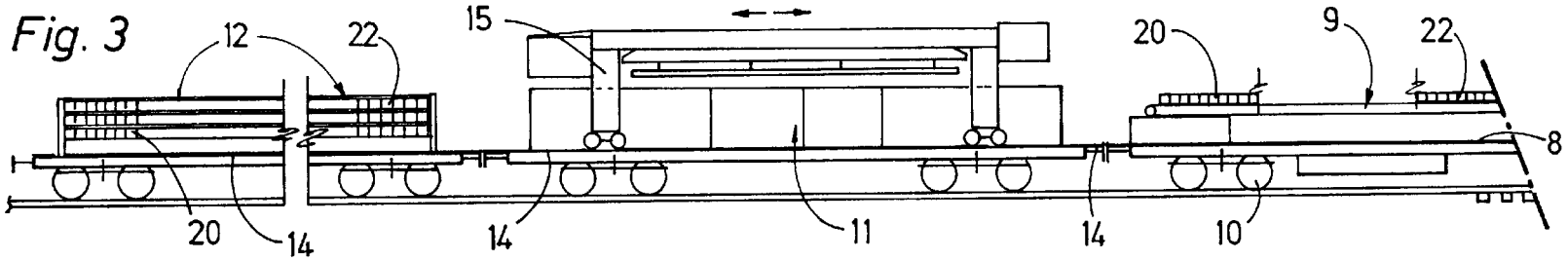
FIG. 3 is a similar side elevational view of a tie storage and conveying car coupled to the machine of FIGS. 1 and 2.

Driver's and operator's cab 6 is mounted at one end of machine frame 5 while the opposite end of the machine frame is supported by universal joint 7 on frame 8 of tie conveyance car 9. The tie conveyance car frame is supported by undercarriage 10 running on track 2. As shown in FIG. 3, the tie conveyance car is followed by car 11 holding the power source for the train, and this car is succeeded by a number of tie storage cars 12. A gantry crane 15 runs on rails 14 along cars 9, 11 and 12 up to universal joint 7 to remove old ties from machine 1 and deliver new ties thereto, in an operation that is well known and described in the above-named U.S. patent.

Crawler vehicle 17 is vertically adjustably mounted on machine frame 5. At the track renewal site, the crawler vehicle is lowered to support the driven machine frame on a planed track bed surface from which the old track has been removed.

Figure 2:
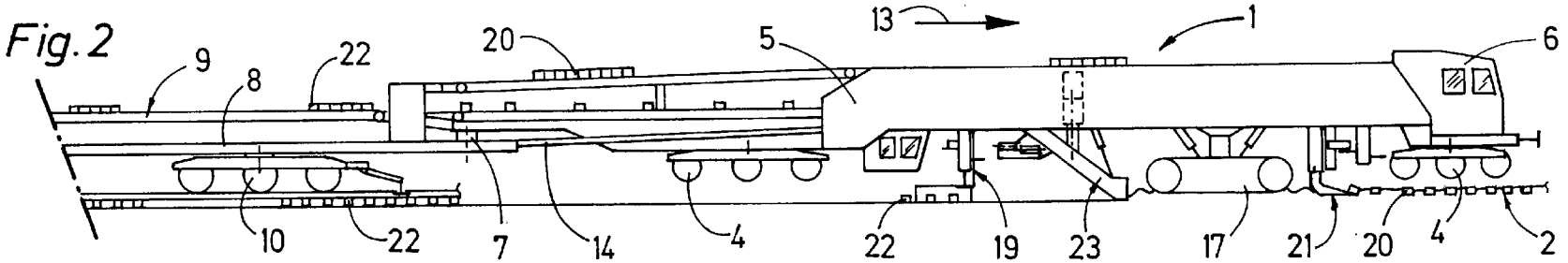

FIG. 2 illustrates the machine of FIG. 1, as it is adapted for operation in the opposite driving direction indicated by arrow 13. As will be described in connection with FIG. 5, tie transport device 19, which was used in the operating mode of FIG. 1 to pick up old ties 20, is now used to lay new ties 22 while tie transport device 21 picks up old ties 20. Ballast bed planing apparatus 23 has been turned 180° to face in the driving direction indicated by arrow 13.

Figure 4:
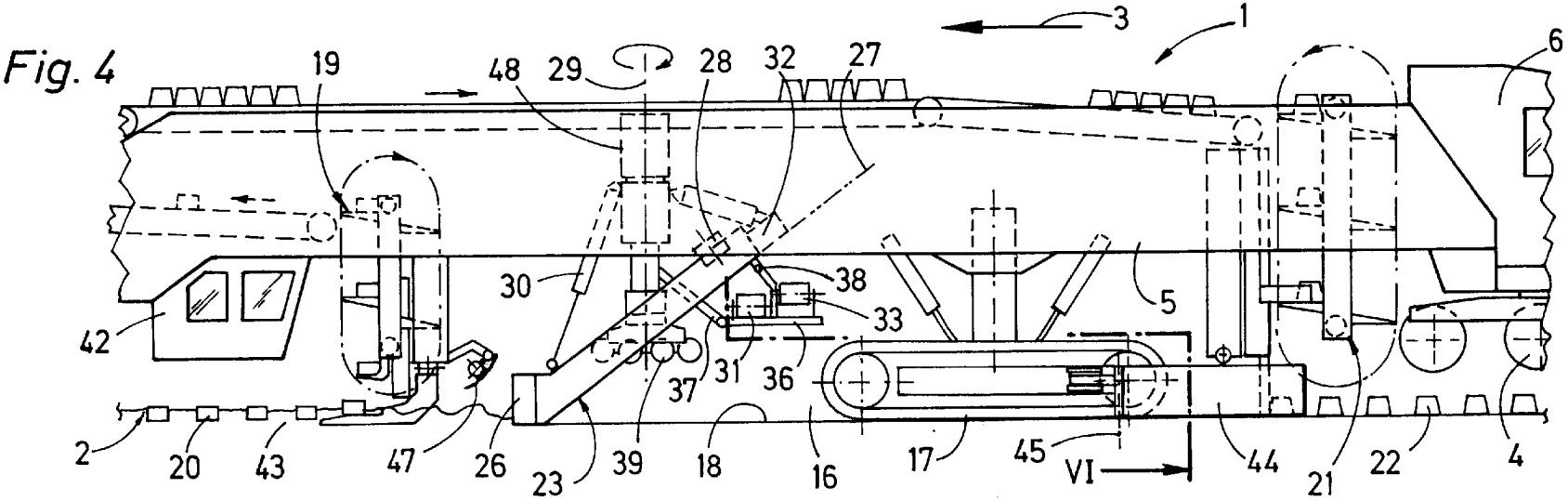
FIGS. 4 and 5 are enlarged, fragmentary side elevational views showing details of the area of the machine where the ballast planing apparatus is located, in the respective positions of the ballast planing apparatus when the driving direction is reversed.

As clearly shown in FIG. 4, the ballast bed planing apparatus comprises endless ballast excavating chain 26 extending in plane 27 inclined relative to the ballast bed. Drive 28 revolves the excavating chain in this plane, and drive 30 is connected to the excavating chain to enable it to be vertically adjusted. Ballast excavating chain 26 has a ballast discharge point 32 vertically spaced from the ballast bed. A conveyor band 31 extends transversely to the longitudinal direction and is arranged underneath ballast discharge point 32 to receive ballast from the ballast discharge point (see FIG. 6).

Figure 6:
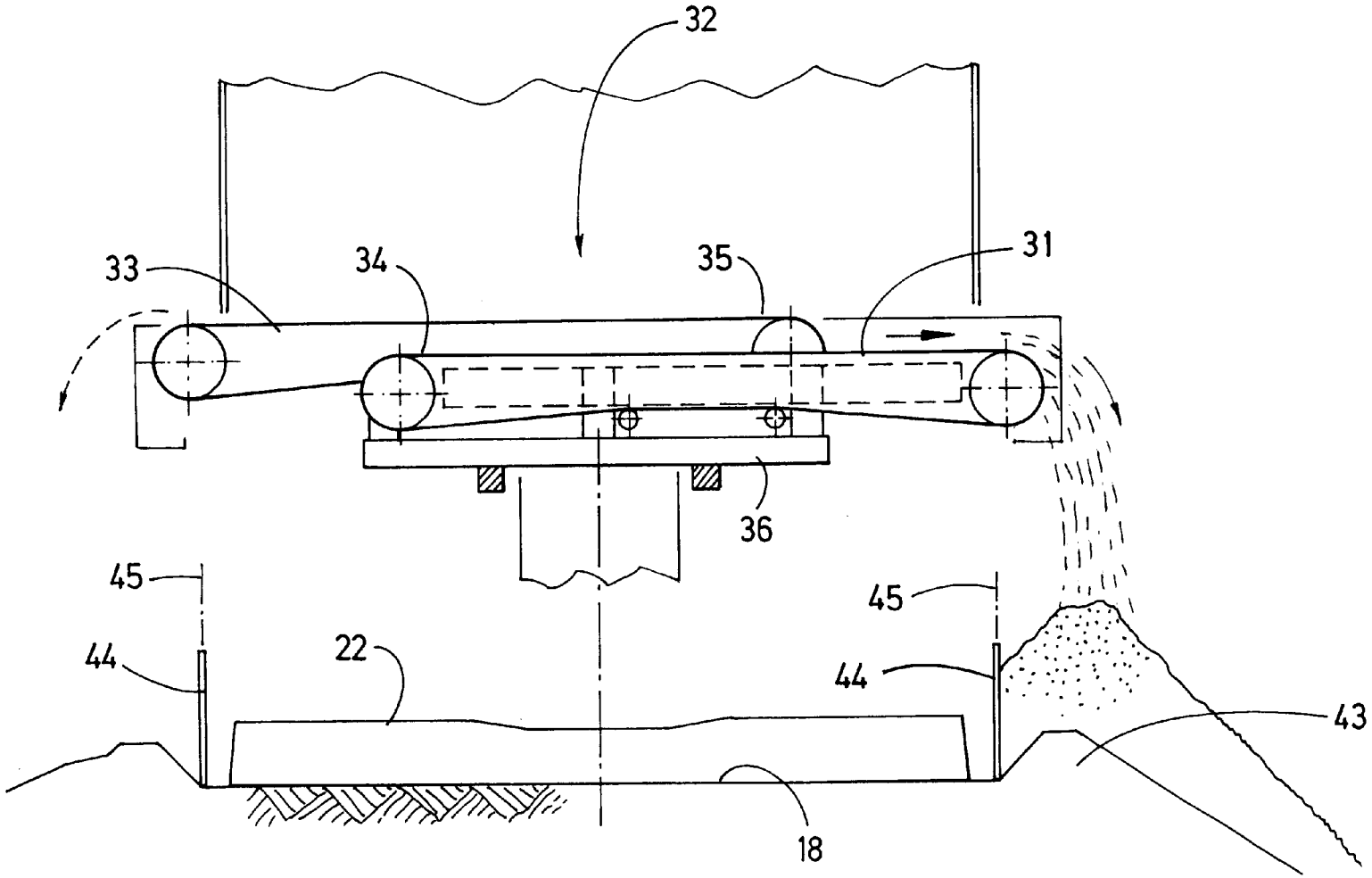
FIG. 6 is a sectional view along line VI in FIG. 4.

A second conveyor band 33 extends transversely to the longitudinal direction, and conveyor bands 31, 33 are arranged one behind the other in the longitudinal direction and are vertically offset from each other. As shown in FIG. 6, each conveyor band has input end 34, 35 in the middle of the railroad track underneath ballast discharge point 31 of excavating chain 26. The transversely extending conveyor bands 31, 33 are mounted on common carrier frame 36 which is connected to the ballast bed planing apparatus by parallelogram linkage 37 for vertically adjusting the conveyor bands about axes 38 extending perpendicularly to the longitudinal direction.

In the operating stage illustrated in FIG. 4, machine 1 has been positioned with the aid of vertically adjustable auxiliary carriage 39 in operating site 16 from which the ties and rails have been removed, and crawler vehicle 17 has been lowered to support the machine in this track renewal site for movement in the direction indicated by arrow 3. As the machine advances in this direction, old rails 40 of old track 2 are lifted off old ties 20 by rail guide devices 41 (FIG. 1) which lead the lifted rails away from the machine. Under the control of an operator in cab 42, the old ties are then removed from ballast bed 43 with tie transport device 19, and the removed old ties are conveyed forwardly to tie transport car 9, shown in FIG. 3, where they are stored in stacks. The stacks of old ties 20 are then taken by gantry crane 15 to tie storage cars 12.

After old track 2 has thus been removed from ballast bed 43, excavating chain 26 of ballast bed planing apparatus 23 is revolved to remove the ballast to expose subgrade 18. As shown in FIG. 6, a respective one of transversely extending conveyor bands 31, 33 conveys the excavated ballast to a respective shoulder of the track and deposits it on the shoulder. Which input end 34 or 35 of conveyor band 31 or 33 is positioned underneath discharge point 32 of excavating chain 26 can be determined by swinging the conveyor bands about axes 38 with parallelogram linkage 37, and this determines on which shoulder the ballast is deposited.

Vertically adjustable crawler vehicle 17, which trails ballast bed planing apparatus 23 in the operating direction, runs on the subgrade and compacts the same. As shown in FIG. 6, vertical shields 44 are hinged to the sides of crawler vehicle 17 and may be pivoted about vertical axes 45. This prevents the ballast to flow back from the shoulders to subgrade 18 before new ties 22 are laid by tie transport device 21 which trails the crawler vehicle. The new rails are then laid by machines following machine 1 (which are not illustrated).

Figure 5:
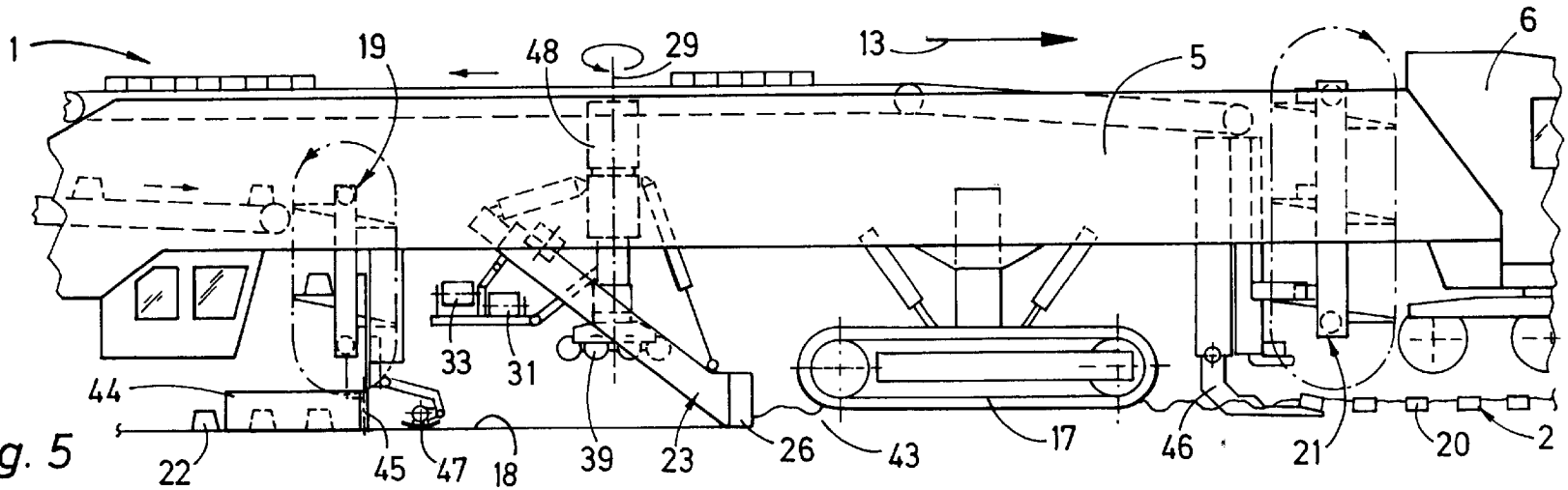

To assume the operating mode illustrated in FIG. 5, in which machine 1 is driven in the opposite direction indicated by arrow 13, ballast bed planing apparatus 23, with conveyor bands 31, 33 connected thereto, is turned 1800 about vertical axis 29. Tie transport device 21 now precedes the ballast bed planing apparatus and the crawler vehicle in the operating direction to remove the old ties, for which purpose tie pick-up device 46 is mounted on the tie transport device. The trailing crawler vehicle now moves on ballast bed 43, from which old track 2 has been removed, and ballast bed planing apparatus 23 trailing crawler vehicle 17 planes the bed. The resultant subgrade 18 is compacted by compacting device 47 vertically adjustably mounted on tie transport device 19 before new ties 22 are laid by the tie transport device. In FIG. 4, compacting device 47 is illustrated in its raised, inoperative position while it is shown in its lowered, operative position in FIG. 5. The transport and conveyance of the old and new ties from and to machine 1 is the same as described hereinabove.

If preferred, the ballast bed planing apparatus may be a V-shaped ballast plow, instead of an excavating chain.

What is claimed is:

1. A machine for renewing a railroad track on a ballast bed, which comprises (a) a machine frame extending in a longitudinal direction, (b) undercarriages for supporting the machine frame on the railroad track, (c) a first tie transport device for receiving old ties and a second tie transport device for laying new ties, the tie transport devices being mounted on the machine frame and being spaced from each other in the longitudinal direction, and (d) a crawler vehicle and ballast bed planing apparatus arranged on the machine frame between the tie transport devices, (1) the ballast bed planing apparatus being rotatable by 180° about a vertical axis.

2. The machine of claim 1, wherein the ballast bed planing apparatus comprises an endless ballast excavating chain extending in a plane inclined relative to the ballast bed and a drive for revolving the excavating chain, the excavating chain having a ballast discharge point vertically spaced from the ballast bed, and further comprising a conveyor band extending transversely to the longitudinal direction and arranged underneath the ballast discharge point to receive ballast from the ballast discharge point.

3. The machine of claim 2, further comprising a parallelogram linkage connecting the conveyor band to the ballast bed planing apparatus for vertically adjusting the conveyor band about axes extending perpendicularly to the longitudinal direction.

4. The machine of claim 2, comprising a second conveyor band extending transversely to the longitudinal direction, the conveyor bands being arranged one behind the other in the longitudinal direction and vertically offset from each other, each conveyor band having an input end in the middle of the railroad track underneath the ballast discharge point of the excavating chain.

* * * * *